US005793390A

United States Patent [19]

Claflin et al.

[11] Patent Number: 5,793,390

[45] Date of Patent: Aug. 11, 1998

[54] WET-WIPE MAINTENANCE DEVICE FOR A FULL-WIDTH INK-JET PRINTER

[75] Inventors: Alfred J. Claflin, Fairport; David G. Anderson, Ontario, both of N.Y.

[73] Assignee: Xerox Corporation, Stamford, Conn.

[21] Appl. No.: 391,326

[22] Filed: Feb. 21, 1995

Related U.S. Application Data

[63] Continuation of Ser. No. 47,931, Apr. 19, 1993, abandoned.

[51] Int. Cl.[6] ..... B41J 2/165

[52] U.S. Cl. ..... 347/33; 347/28; 347/30

[58] Field of Search ..... 347/21, 22, 28, 347/30, 33, 40, 42, 95; 346/140 R, 1.1

[56] References Cited

U.S. PATENT DOCUMENTS

| | | | |
|---|---|---|---|
| 3,953,353 | 4/1976 | Barrett, Jr. et al. | 510/283 |
| 4,340,897 | 7/1982 | Miller | 347/33 |
| 4,546,363 | 10/1985 | Iwagami | 347/28 |
| 4,567,494 | 1/1986 | Taylor | 347/30 |
| 4,670,218 | 6/1987 | Gantzer et al. | 422/56 |
| 4,746,938 | 5/1988 | Yamamori et al. | 347/28 |
| 4,814,794 | 3/1989 | Sato | 347/28 |
| 4,829,318 | 5/1989 | Racicot et al. | 347/33 |
| 4,853,717 | 8/1989 | Harmon et al. | 347/29 |
| 4,947,191 | 8/1990 | Nozawa et al. | 347/30 |
| 5,055,861 | 10/1991 | Murayama et al. | 347/29 |
| 5,084,712 | 1/1992 | Hock et al. | 347/28 |
| 5,089,846 | 2/1992 | Tabuchi | 347/149 X |
| 5,184,147 | 2/1993 | MacLane et al. | 347/30 |
| 5,250,962 | 10/1993 | Fisher et al. | 347/32 |
| 5,339,842 | 8/1994 | Bok | 134/1 |
| 5,398,054 | 3/1995 | Fukazawa et al. | 347/33 |

FOREIGN PATENT DOCUMENTS

| | | | |
|---|---|---|---|
| 0335699 | 10/1989 | European Pat. Off. | B41J 3/04 |
| 0101460 | 8/1980 | Japan | B41J 3/04 |
| 0077944 | 4/1987 | Japan | B41J 3/04 |
| 5042678 | 2/1993 | Japan | 347/22 |
| 2203994 | 11/1988 | United Kingdom . | |

OTHER PUBLICATIONS

*Webster's Ninth New Collegiate Dictionary*, Merriam-Webster Inc., 1990, pp. 456, 813, and 911.

*Primary Examiner*—David F. Yockey
*Attorney, Agent, or Firm*—Tallam Nguti

[57] ABSTRACT

A maintenance device includes a shuttle which is adapted to travel on a track through a fixed path generally parallel to the array. Mounted on the shuttle are an application, which includes a wicking member, for applying a cleaning liquid to the nozzle openings and a vacuum device for applying suction to the nozzle openings. A spacing member on the shuttle spaces the shuttle from the head to form a meniscus of the cleaning liquid against the nozzle openings of the printhead. The maintenance device is used in a cleaning method wherein a vacuum force is applied to the nozzle openings while moving the shuttle in a first direction, the surface is wetted by the cleaning liquid while moving the shuttle in a second direction, and the a vacuum force is again applied to the nozzle openings after the wetting while moving the shuttle in the second direction.

9 Claims, 2 Drawing Sheets

WET-WIPE MAINTENANCE DEVICE FOR A FULL-WIDTH INK-JET PRINTER

This is a continuation of application Ser. No. 08/047,931, filed Apr. 19, 1993 abandoned.

CROSS-REFERENCE TO RELATED APPLICATIONS

This application incorporates by reference co-pending patent application Ser. No. 08/048,599 abandoned, entitled "Printhead Maintenance Device for a Full-Width Ink-Jet Printer," being filed concurrently herewith.

BACKGROUND OF THE INVENTION

1. Field of the Invention

The present invention relates to ink-jet printing, and is more particularly concerned with an effective liquid applicator/vacuum device for cleaning contaminants from a full-width array ink-jet printhead.

2. Description of Related Art

In existing thermal ink jet printing, the printhead typically comprises one or more ink ejectors, such as disclosed in U.S. Pat. No. 4,463,359, each ejector including a channel communicating with an ink supply chamber, or manifold, at one end and having an opening at the opposite end, referred to as a nozzle. A thermal energy generator, usually a resistor, is located in each of the channels, a predetermined distance from the nozzles. The resistors are individually addressed with a current pulse to momentarily vaporize the ink and form a bubble which expels an ink droplet. As the bubble grows, the ink rapidly bulges from the nozzle and is momentarily contained by the surface tension of the ink as a meniscus. As the bubble begins to collapse, the ink still in the channel between the nozzle and bubble starts to move towards the collapsing bubble, causing a volumetric contraction of the ink at the nozzle and resulting in the separation of the bulging ink as a droplet. The acceleration of the ink out of the nozzle while the bubble is growing provides the momentum and velocity of the droplet in a substantially straight line direction towards a print sheet, such as a piece of paper. Because the droplet of ink is emitted only when the resistor is actuated, this type of thermal ink-jet printing is known as "drop-on-demand" printing. Other types of ink-jet printing, such as continuous-stream or acoustic, are also known.

In a single-color ink jet printing apparatus, the printhead typically comprises a linear array of ejectors, and the printhead is moved relative to the surface of the print sheet, either by moving the print sheet relative to a stationary printhead, or vice-versa, or both. In some types of apparatus, a relatively small printhead moves across a print sheet numerous times in swaths, much like a typewriter; alternatively, a printhead which consists of an array of ejectors and extends the full width of the print sheet may be passed once down the print sheet to give full-page images, in what is known as a "full-width array" (FWA) printer. When the printhead and the print sheet are moved relative to each other, imagewise digital data is used to selectively activate the thermal energy generators in the printhead over time so that the desired image will be created on the print sheet.

With any kind of ink-jet printer in which a printhead is in close and extended contact with a substrate such as a sheet of paper with partially-dried ink thereon, an important practical concern is contamination of the area around the ejectors. External debris such as lint or stray paper fibers are likely to become caught in the small gap between the front face of the printhead and the sheet, possibly entering the nozzles of the ejectors and causing a failure of ejectors. Another cause of failure of individual ejectors is the fact that, if a particular ejector is not used for an appreciable length of time, even while the system is printing a document, a "viscous plug" of partially-dried ink will, in effect, cause a clot in the particular ejector, causing the ejector to fail at least temporarily, at least until the reheating of the particular ejector softens the viscous plug. A viscous plug often creates a partial blockage of an ejector, causing an ink droplet ejected therefrom to be misdirected. In ink-jet printers, a failure of even one ejector will have conspicuous results on a print, because the plugged ejector will leave a blank stripe across a printed area where the ink from the ejector should have been placed. Thus, the failure of even a very few ejectors in a system will render the entire system unsatisfactory to a demanding user. Therefore proper cleaning and maintenance of the area around the ejectors and between the ejectors and the substrate is of crucial importance to a practical ink-jet printer.

In a full-width array (FWA) printer, a generally different architecture is required to perform an effective cleaning of the printhead. Simply to wipe across the linear array in the direction the linear array is extending tends to be unsatisfactory because, with such a long wiping difference, contaminants removed from one end of the array will tend to be merely pushed to the nozzles on the other end of the array; i.e., with a long wiping distance, contaminants will tend to be simply moved from one ejector to another. What is needed is a maintenance station and FWA ink-jet printer which may rapidly clean across a long array without causing contaminants to be simply moved from one side of nozzles to another.

U.S. Pat. No. 4,340,897 discloses a cleaning device for an ink-jet writing head wherein the nozzles of the writing head are urged into contact with a manifold having a set of brushes thereon. Vacuum is applied through the brushes to remove excess ink from the nozzles.

U.S. Pat. No. 4,546,363 discloses a nozzle cleaning device which blows a cleaning solvent against the nozzle portion of a printer head in an ink-jet printer. The ejecting unit includes a plurality of orifices, and a quantity of cleaning solvent is sprayed, by means of a piston, onto the nozzle of the printer head.

U.S. Pat. No. 4,567,494 discloses an ink-jet printer, the nozzles of which are primed and cleaned after each print line by engaging the nozzles with an elastomeric suction cup. The suction cup includes an inner cup of foam which wipes of any residual ink droplets. The cup is connected to a vacuum pump for drawing ink out of the nozzles.

U.S. Pat. No. 4,746,938 discloses an ink-jet printer having a heat washing unit disposed beyond one end of the printing area. The heat washing unit includes an ink mist suction unit which sucks ink mist around the ink-jet unit and the anti-clogging unit, which prevents clogging of the nozzles.

U.S. Pat. No. 4,814,794 discloses a cleaning device for the nozzle of an ink-jet printer, wherein cleaning liquid is supplied from a bag in a disposable cartridge and sprayed on the side of a nozzle in the printhead.

U.S. Pat. No. 4,829,318 discloses a maintenance system for purging and cleaning an ink-jet printhead, including a self-aligning purge nozzle which floats into positive engagement with a vent hole of the printhead, and a wiping roller about which a tape of wiping cloth passes.

U.S. Pat. No. 4,853,717 discloses a maintenance station for an ink-jet printer comprising a pump for priming the printhead, and wiping means for cleaning the printhead. The wiper is stationary relative to the apparatus, so that when the printhead on a carriage passes across the wiper in the carriage motion, the wiper is moved across the front face of the printhead.

U.S. Pat. No. 5,084,712 discloses a maintenance system for an ink jet printer, including a solvent supply system for spraying solvent on the faces of the ink-jets and in the ink-jet openings, and a brush for scrubbing the ink-jet faces during and immediately after the spraying process. The solvent vapors enter the jets and deprime the jets so that the ink remaining in the jets drains out back into an ink reservoir.

U.S. Pat. No. 5,184,147 discloses an ink-jet printhead maintenance system having means for applying a vacuum to the ink-jet nozzles in the printhead. An elongated wiper engages and wipes the surface of the nozzles and is preferably moved at an extremely slow rate across the surface to enhance the wiping operation. A specialized drip edge is positioned beneath the orifice surface for directing drops of ink away from the ink-jet printhead which are generated during the cleaning procedure.

SUMMARY OF THE INVENTION

According to the present invention, there is provided an ink-jet printer comprising a printhead, defining an array of nozzle openings for the emission of ink droplets therethrough. A shuttle for applying a liquid to a nozzle opening travels on a track through a fixed path generally parallel to the array, thereby applying liquid to a series of nozzle openings in the array.

According to another aspect of the present invention, there is provided a method for maintenance of a printhead having a surface defining an array of nozzle openings for the emission of ink droplets therethrough. An applicator applies a liquid at a predetermined pressure into a nozzle opening. The applicator is moved along the main direction of the array to apply the liquid to a series of nozzle openings in the array.

According to still another aspect of the present invention, there is provided a method of maintaining a printhead having a surface defining an array of nozzle openings for the emission of ink droplets therethrough, the array of nozzle openings extending in a main direction. A shuttle is provided, the shuttle having an applicator for applying a liquid at a predetermined pressure into a nozzle opening, and a vacuum orifice for applying suction to a nozzle opening. The shuttle is moved generally parallel to the main direction of the array of nozzle openings while applying suction to a series of nozzle openings in the array. The shuttle is again moved generally parallel to the main direction of the array of nozzle openings while applying liquid to the series of nozzle openings, and also while applying suction to the series of nozzle openings in the array.

According to still another aspect of the present invention, there is provided a method of maintaining a printhead having a surface defining an array of nozzle openings for the emission of ink droplets therethrough, the array of nozzle openings extending in a main direction, the nozzle openings being adapted to retain liquid ink therein at a predetermined back-pressure. A shuttle is provided, the shuttle having a vacuum member for applying suction to a nozzle opening without contacting the surface. The shuttle is moved generally parallel to the main direction of the array of nozzle openings while applying suction to a series of nozzle openings in the array.

DESCRIPTION OF THE PREFERRED EMBODIMENTS

Figure 1:
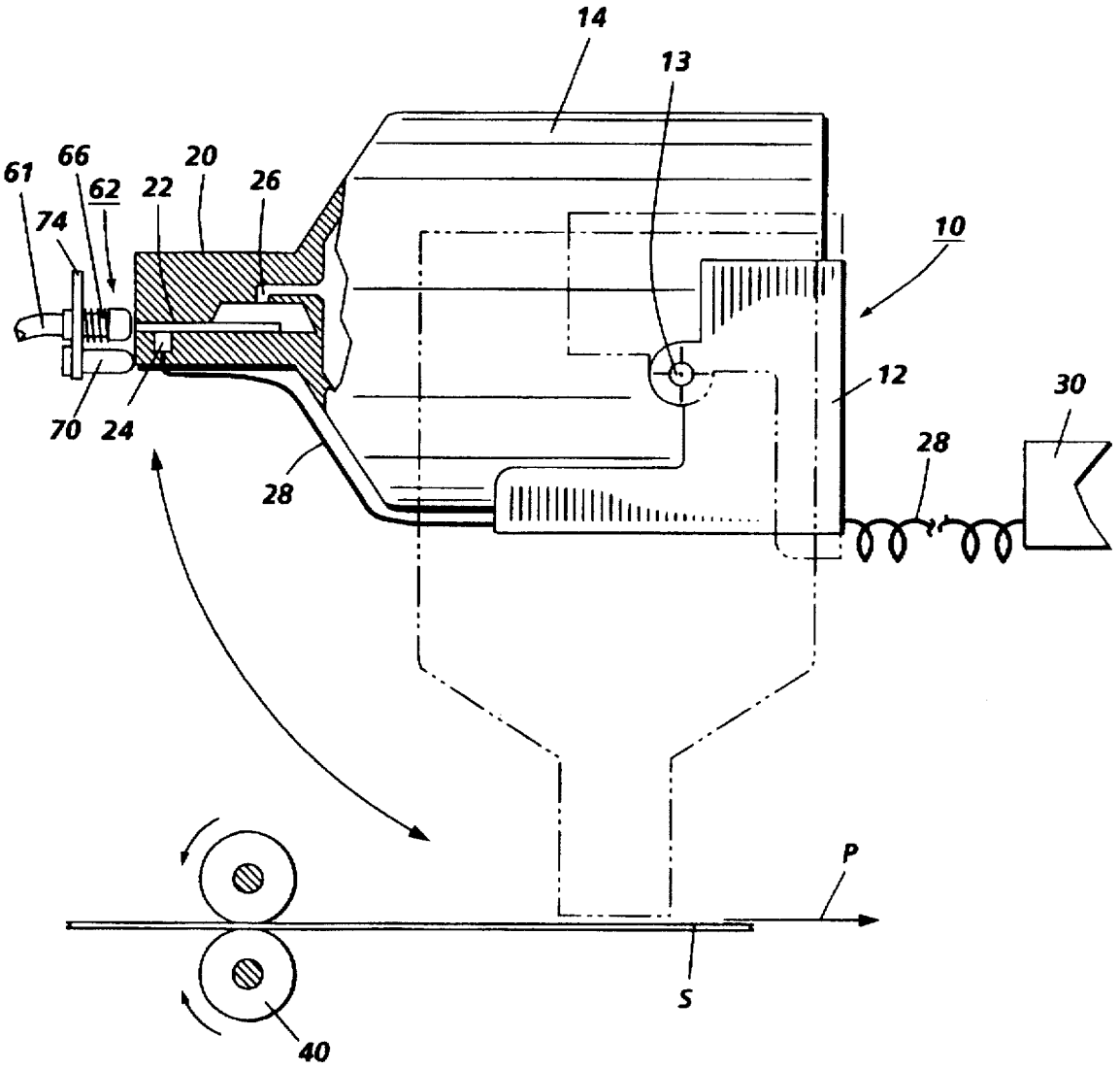
FIG. 1 is an elevational view showing the elements of a full-width array thermal ink-jet printer with which the present invention is suitable for use.

FIG. 1 is an elevational view showing a thermal ink-jet printer having a full-width linear array of ejectors which extend across the width of a sheet S moving through the system in process direction P. In the view of FIG. 1, the linear array of ejectors extend into the page. There is provided in this embodiment of the printer an ink supply cartridge generally indicated as 10, which is mounted on a carriage 12. The cartridge 10 is preferably removably mounted in carriage 12 for the replacement thereof when the ink in the cartridge 10 is expended. The bulk of cartridge 10 is an ink supply generally indicated as 14, which in the embodiment shown is of a single color in one chamber, but one skilled in the art will appreciate that multiple chambers may be provided within cartridge 10 to facilitate the supply of multiple colors to the printer. The other important portion of cartridge 10 is the printhead, generally indicated as 20. Printhead 20, in a full-width array printer, comprises at least one linear array of selectively-actuable ejectors, (only one of which is shown in this end-on view) which are controlled by a series of leads thereto to a controller 30, which will activate the various ejectors in printhead 20 in accordance with image data during the printing operation. Each ejector in printhead 20 includes an ink channel 22 which terminates in an opening at the outer portion of the printhead through which ink is ejected. Adjacent each channel 22 is a heating element 24 which, when voltage is introduced therein, causes the rapid heating of liquid ink in the channel 22, causing the liquid ink to be ejected out of the printhead 20 and onto the sheet. A new supply of ink is introduced into an individual channel 22 as needed through an ink supply manifold 26, which is connected through various means to one of any number of ink supply chambers in the ink supply 14, depending on the desired color of ink to be emitted from the particular channel 22. The various heating elements 24 for each ejector in the linear array are connected, by serial, parallel, or a combination of parallel and serial means, to a bus 28 which is ultimately connected to a controller 30 for the operation thereof to create an image on the sheet.

The embodiment shown in FIG. 1 shows the carriage 12 holding cartridge 10 in such a position that the cartridge 10 is in its non-printing or "maintenance" mode. This is the position of the cartridge 10 so that the printhead 20 thereof is not directed toward the sheet S, but rather directed away so that ink in any of the channels 22 will not leak onto the sheet or, if there is no sheet in the printer, into the machine in general when the system is idle. When printing is desired, carriage 12 pivots, as by pivot 13, to direct the printhead 20 toward the sheet S. During the printing operation, sheet S is typically moved in a continuous fashion across the printhead 20 by means such as rollers 40, actuated by a motor (not shown). Coordination of the operation of the printhead 20 by controller 30 with the position of the particular sheet S through the printer will be apparent to one skilled in the art.

Of course, if a multi-color printer is contemplated, there will typically be provided a plurality of parallel linear arrays of ejectors in the printhead 20, the ejectors in each array being connected to a particular color ink supply within the cartridge 10. Further, in various systems there may be provided multiple types of inks of the same color but of different drying rates, as would be required for a particular architecture. There may also be provided within the system, downstream of the printhead 20 in process direction P, any of various means to enhance or increase the rate of the drying of ink placed on the sheet, thereby to prevent smearing of the image as the sheet moves further along the system. Typical drying means may include convection or radiant heaters, a microwave device, or a light-flash device.

Figure 2:
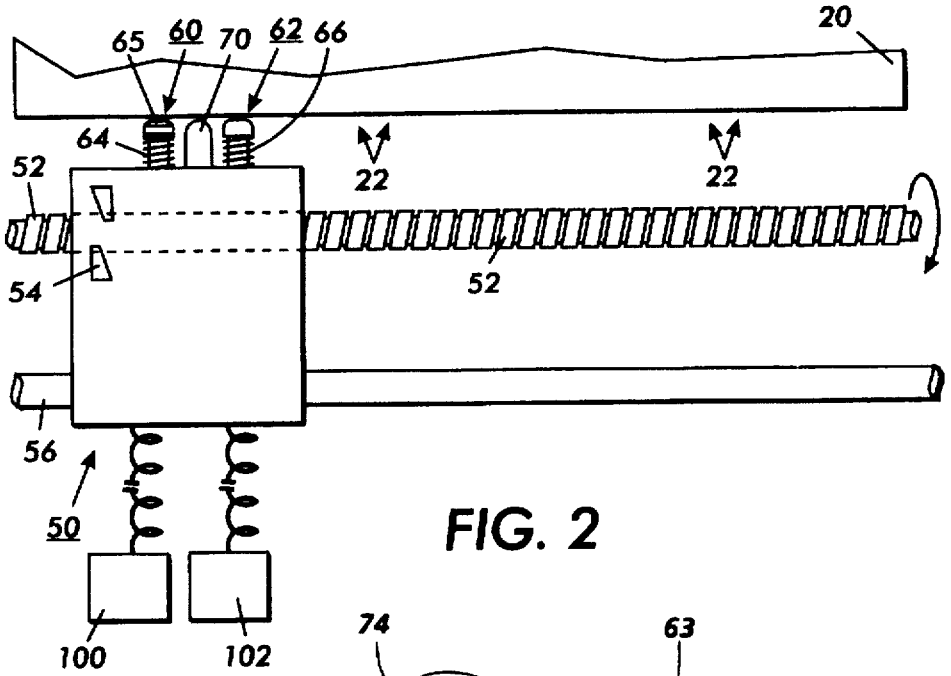
FIG. 2 is a plan view showing a maintenance device according to the present invention interacting with the printhead of a full-width array ink-jet printer.

FIG. 2 is a plan view of the relevant portions of the printer, showing how a maintenance station of the present invention is used to clean the front face of printhead 20. The basic elements of the present invention include a shuttle generally indicated as 50, which travels along a rotating lead screw 52, which is typically caused to rotate axially by means of a motor (not shown). As lead screw 52 rotates, a structure such as fingers 54 located on the shuttle will cause the shuttle to move longitudinally as the fingers 54 interact with the threading on lead screw 52. Shuttle 50 may also include means for engaging a guide rail 56, which in this embodiment is a smooth rail which serves to maintain the rotational position of the shuttle 50 relative to the lead screw 52, ensuring that the shuttle 50 does not rotate with the lead screw when the lead screw 52 is rotated. In this way, lead screw 52 and guide rail 56 function as a "track" by which the shuttle 50 may be moved in a predetermined path generally parallel to the face of the full-width printhead 20, when the carriage 12 is holding printhead 20 in the maintenance position.

Mounted on shuttle 50 and disposed to engage the front face of printhead 20, and specifically to engage the nozzle openings of the ink channels 22 of the printhead 20 are a wet wiper 60 and a vacuum nozzle 62. Wet wiper 60 and vacuum nozzle 62 are so disposed relative to the channel 22 in printhead 20 that, when shuttle 50 is caused to move by lead screw 52 across the front face of printhead 20, both the wet wiper 60 and vacuum nozzle 62 will be caused to slide against the nozzles of the channels 22 in printhead 20. In order to maintain a degree of contact between the wet wiper 60 and the vacuum nozzles 62 and the printhead 20, the wet wiper 60 and vacuum nozzle 62 may be gently urged, such as by coil springs 64 and 66, respectively, against the front face of printhead 20.

The purpose of wet wiper 60 is to apply a predetermined amount of cleaning liquid, such as water, to the front face of the printhead 20, and to re-prime (i.e., replenish the liquid ink supply) within the channels 22 of printhead 20. In turn, the purpose of vacuum nozzle 62 is either to directly remove contaminants such as lint and paper fibers from the front face of printhead 20, or to act in conjunction with the wet wiper 60 to remove viscous plugs of partially dried ink from the channels in the printhead 20. The water or other liquid may be supplied by an on-board water source 100 of known design, and the vacuum may be supplied from an on-board vacuum source 102 of known design, both shown schematically in the Figure.

In the preferred method, the shuttle 50 is first moved across the printhead so that the vacuum nozzle 62 is first, that is, leading, in the direction of motion. In this first pass across the printhead in the maintenance cycle, vacuum from the vacuum nozzle 62 is applied to the channels of the printhead in succession. This step, as mentioned above, is a good preliminary first step in removing larger particles such as lint and paper fibers from the front face of the printhead. Preferably, the vacuum through vacuum nozzle 62 is more than one order of magnitude greater than the typical negative pressure experienced by ink within a channel while a particular ejector is idling. The preferred range for the vacuum at the vacuum nozzle is about 4–10 PSI at the nozzle tip. The typical back-pressure for retaining ink within a channel 22 in the printhead 20 is between about −0.03 and −0.15 PSI. In this initial vacuuming step, it is acceptable that the vacuum nozzle 62 remove 10–20 channel-length volumes of ink, or about 0.002–0.004 microliters of material from each channel to clean the channel. In this way, every ejector in the full-width printhead will be thoroughly cleaned of viscous plugs.

After the shuttle 50 has moved across the printhead 20 one time, according to the preferred method of the present invention, the direction of shuttle 50 is reversed, such as by reversing the direction of rotation of lead screw 52 in the illustrated embodiment, so that the shuttle 50 moves across the linear array of ejectors in printhead 20 with the wet wiper 60 first, that is, leading. As wet wiper 60 moves across the front face 21 of printhead 20, the wet wiper 60 applies a small quantity of water (from a source not shown) to the front face of the printhead. According to a preferred embodiment of ink-jet printheads, the front face 21 of printhead 20 is a hydrophobic surface, preferably fluorinated carbon DLC ("diamond-like coating"), which will cause the applied water to bead on the front face. Basically, the wet wiper 60 is in the form of a wick having enough outward pressure thereon to cause a small quantity of water to bridge from the wet wiper 60 to the front face of the printhead 20 when printhead 20 is in its maintenance mode position, without causing undue "weeping" of excess water into the system in general. A preferred range for outward water pressure from the wet-wiper 60 for meniscus wiping is between about 0.015 and 0.075 PSI. This water serves a number of purposes. First, the small amount of water imparted to the printhead 20 by the wet wiper 60 restores a necessary amount of relative humidity to the area around the channels. This relative humidity is helpful in, for example, decreasing the likelihood of viscous plugs of dried ink forming too soon within the channels. Further, the water may have diluted therein a relatively small amount of a detergent, which may be useful in removing certain kinds of dirt and other debree from the area around the channels. Of course, following the application of liquid on the "return trip" of the shuttle 50, the printhead 20 is almost immediately vacuumed again through vacuum nozzle 62. Once again, this step of the preferred method is helpful in restoring the "prime" of available liquid ink within the channels immediately before the printing of a job.

Ink and other contaminants collected through the vacuum nozzle 62 may be separated from an air flow through known means, such as a separation chamber within the apparatus.

Figure 3:
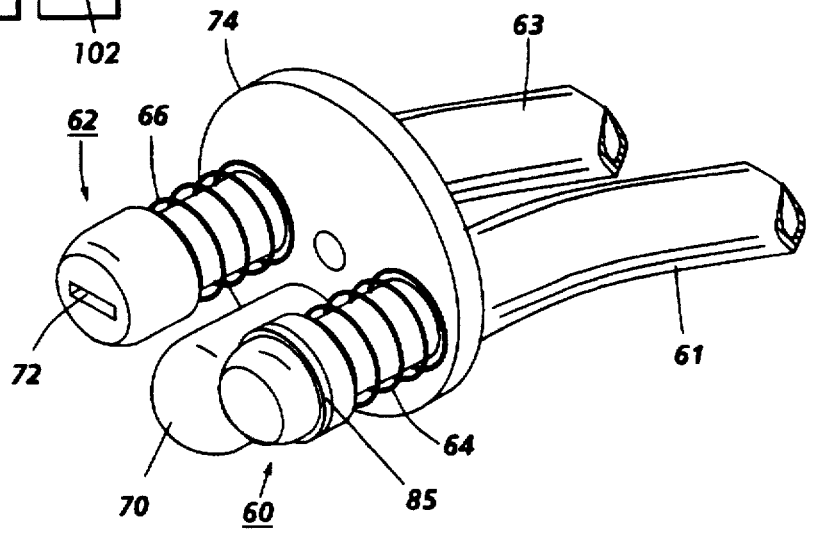
FIG. 3 is a perspective view showing in isolation significant elements of a maintenance device according to the present invention.

FIG. 3 is a perspective view of wet wiper 60 and vacuum nozzle 62 as they face the printhead 20. The structure of wet wiper 60 will be discussed in detail below. Generally speaking, typical diameters for the wet wiper 60 and the vacuum nozzle 62 are from one-quarter inch to one-half inch. There may also be included a follower 70, of comparable size and shape to the wet wiper 60 and vacuum nozzle 62, which is intended to engage an area adjacent the printhead 20, when the printhead 20 is in maintenance mode, to serve as a spacer for proper contact of wet wiper 60 and vacuum nozzle 62 to the area on the printhead 20 around the channels 22. Vacuum nozzle 62 is preferably in the form of a small dome having a slit-like orifice 72 defined therein and oriented to follow the direction of the linear array of ejectors in printhead 20. This orifice 72 is adapted to encompass a subset of nozzles in the array of the printhead at a given time as the shuttle 50 move across the entire array. The outer surface of vacuum nozzle 62, as well as of follower 70, is preferably of a low-friction plastic material, and, in particular, of TEFLON® (polytetrafluoroethylene plastic material) impregnated DELRIN A/F® (basically, TEFLON fibers dispersed in acetal resin). In addition to or in lieu of spring-loading the wet wiper 60 and vacuum nozzle 62 separately, the wet wiper 60, vacuum nozzle 62 and follower 70 may be together molded on a single plastic plate such as 74, which may be springably mounted itself on the shuttle 50. The wet wiper 60 and vacuum nozzle 62 are connected to sources of vacuum or liquid supply through flexible tubing such as 61 and 63, respectively.

Figure 4:
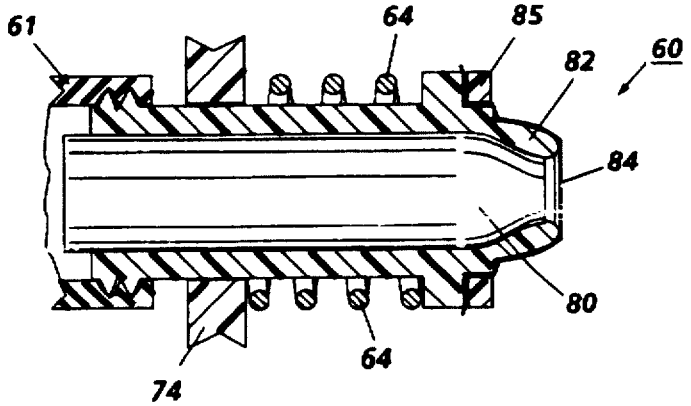
FIG. 4 a sectional elevational view of a wet wiper according to the present invention.

FIG. 4 is a sectional elevational view of wet wiper 60 according to a preferred embodiment of the present invention. The main portion of wet wiper 60 comprises a wick 80 of urethane felt, which is reticulated and compressed within an outer tube 82. A preferred wicking material is a reticulated felted foam with a compression ratio of 4:1 made by Scott Inc. and sold under the trade name SIF FELT (reticulated felted foam material). At the effective tip of wet wiper 60 is provided a low-friction wiping member 84 which is preferably made of a mesh of hydrophilic NYLON—(a polyimide material) such as that made by Tetko Inc. and sold under the trade name NITEX (nitofurantoin)®. Water from an external source (not shown) is supplied through the wicking felt 80 to create a slight positive pressure outward from the wet wiper 60 through the NYLON mesh in tip 84. A ring 85, of metal or plastic, is useful for retaining the wiping member 84 on the tip.

The tip of the wet wiper 60 should be spaced 5 mils or less from the front face of the printhead 20. It is preferred that the wet wiper 60 not be in any contact with the front face 21. Rather, it is intended that the outward pressure of liquid at the tip of the wet wiper 60 create a positive meniscus 65 that "bridges" over to the front face 21. With this "cushion" of liquid between the wet wiper 60 and the front face 21, the wet wiper 60 may glide along the front face, wiping away contaminants and depositing liquid into the nozzle openings, while avoiding any solid-to-solid contact, which is likely to abrade and ultimately damage the front face of the printhead. The same spacing principle applies to vacuum nozzle 62: the trail of liquid that is left behind as the wet wiper 60 moves along the array may be effectively vacuumed off the front face 21 even when the vacuum nozzle 62 is not in actual contact with the front face 21. Again, the preferred spacing for the vacuum nozzle 62 is less than 5 mils from the front face 21.

In a preferred operation of the present invention, under the controls of the rotated screw 52, pivots 13 and controller 30, the maintenance routine of causing the shuttle 50 to move back and forth once across the front face of the printhead 20 in the maintenance mode position is carried out at least after every job, and also perhaps at periodic intervals, for example, of one hour, when the machine is generally idling. One danger of using a thermal ink-jet printer with a large number of ejectors is that prolonged idling will increase the likelihood of partial evaporation of ink, causing viscous plugs to be formed in some of a large number of channels; by providing a periodic automatic maintenance routine, the integrity of the large number of ejectors may be preserved.

As a possible alternative to the solid, dome-shaped follower 70, there may also be provided as a follower a floating ball bearing to reduce friction toward portions of the printer adjacent the printhead face. This follower is useful in maintaining the desired spacing of the wet wiper 60 and vacuum nozzle 62 from the front face 21 of the printhead 20, particularly if the wet wiper 60, or vacuum nozzle 62, or both, are spring-loaded relative to the front face.

While this invention has been described in conjunction with various embodiments, it is evident that many alternatives, modifications, and variations will be apparent to those skilled in the art. Accordingly, it is intended to embrace all such alternatives, modifications, and variations as fall within the spirit and broad scope of the appended claims.

What is claimed is:

1. A maintenance apparatus for cleaning the surface and nozzles of a full-width array ink-jet printhead in a maintenance position without causing contamination to be simply moved from nozzles on one side to nozzles on another side of the full width array printhead, the maintenance apparatus comprising:

(a) a shuttle device within the ink-jet printer for movement adjacent to and relative to the nozzles of the ink-jet printhead;

(b) means for moving said shuttle device in a first direction relative to the nozzles of the printhead, and reversibly in a second direction opposite to said first direction;

(c) a vacuum applying device mounted on said shuttle device for applying a suction force to the surface and nozzles when being moved in said first and in said second directions to remove liquid and contaminants from the surface and nozzles without causing contamination to be simply moved from nozzles on one side to nozzles on another side of the full width array printhead;

(d) a wetting device containing a wicking member therein, said wetting device containing a cleaning liquid and mounted on said shuttle device downstream of said vacuum applying device relative to said first direction, for forming a meniscus of the cleaning liquid against the surface and nozzles to wet dried viscous plugs of ink around the nozzles for removal by said vacuum applying device; and (e) a spacing member mounted on said shuttle between said vacuum applying device and said wetting device for spacing said vacuum applying device and said wetting device from the surface and nozzles of the printhead to enable liquid discharged from said wetting device to form as a meniscus against the surface and nozzles.

2. The maintenance apparatus of claim 1, wherein said vacuum device includes a suction tip having a slit for fitting over a subset of nozzles on the surface of the ink-jet printhead.

3. The maintenance apparatus of claim 1, wherein said wetting device includes a cleaning liquid discharge tip spaced from the surface and nozzles being cleaned creating a space for causing discharged liquid to form as a meniscus therein against the surface and nozzles.

4. The maintenance apparatus of claim 2, wherein said suction tip of said vacuum device includes a wiping material comprising a mesh of polyimide material on its outer surface.

5. The maintenance apparatus of claim 2, wherein said suction tip comprises a dome shaped form having a predetermined diameter for fitting over a subset of the nozzles.

6. The maintenance apparatus of claim 2, wherein said slit is oriented to extend in a direction of nozzles being cleaned.

7. The maintenance apparatus of claim 3, wherein said cleaning liquid discharge tip of said wetting device is spaced forming a space of less than 5 mils from nozzles being cleaned for enabling liquid discharged from said cleaning liquid discharge tip to form as a meniscus in the space and against the surface and nozzles being cleaned without weeping.

8. An ink jet printer comprising:

(a) a full width array printhead having a surface and nozzles through said surface for emitting ink droplets therethrough to print on a substrate; and (b) a maintenance apparatus spaced from said printhead for cleaning said nozzles of said printhead without causing contaminants to be simply moved from nozzles on one side to nozzles on another side of said full width array printhead, said maintenance apparatus including:

(i) a shuttle device movable in a first direction parallel to a linear array formed by said nozzles of said full-width array printhead, and in a second reverse direction opposite said first direction;

(ii) a vacuum device mounted on said shuttle device for applying a suction force to remove contaminants from said surface and said nozzles of said full-width array printhead;

(iii) a wetting device containing a wicking member therein and being mounted on said shuttle device downstream of said vacuum device for applying a wetting liquid onto said surface of said full-width array printhead for removal by said vacuum device; and (iv) a spacing member mounted on said shuttle device between said vacuum applying device and said wetting device for spacing said vacuum applying device and said wetting device from said surface and said nozzles of said full width array printhead to enable meniscus forming of and meniscus wetting by said wetting liquid of said surface and said nozzles.

9. A method of effectively cleaning and maintaining a full-width array ink jet printhead having a surface and ink droplet emitting nozzles through the surface, without causing contamination to be simply moved from nozzles on one side to nozzles on another side of the full-width array printhead, the method comprising the steps of:

(a) applying a vacuum suction force, a first time to the surface and nozzles using a movable vacuum force applying device moving in a first direction parallel to the surface and nozzles of the full-width array printhead, to remove contaminants and dried viscous plugs of ink from the full-width array printhead;

(b) while moving the movable shuttle device in a second and reverse direction opposite the first direction, meniscus wetting the surface and nozzles of the full-width array printhead with a cleaning liquid discharged from a wetting device (i) containing a wicking member therein, (ii) spaced from the surface and nozzles of the full-width array printhead by a spacing member for enabling discharged cleaning liquid to form as a meniscus against the surface and nozzles, and (iii) supported on the movable shuttle device downstream of the vacuum force applying device relative to movement of the movable shuttle device in the second direction; and (c) applying a vacuum suction force, a second time to the surface and nozzles using the vacuum force applying device moving after the wetting device in the second and reverse direction, to effectively remove additional contaminants and viscous plugs of ink from the surface and nozzles of the full-width array printhead, without causing the contaminants to be simply moved from nozzles on one side to nozzles on another side of the full-width array printhead.

* * * * *